United States Patent [19]

Caugherty

[11] Patent Number: 4,593,741

[45] Date of Patent: Jun. 10, 1986

[54] DIE CASTING APPARATUS

[76] Inventor: William C. Caugherty, 4 Edgewater Sq., Lakewood, Ohio 44107

[21] Appl. No.: 598,721

[22] Filed: Apr. 10, 1984

[51] Int. Cl.[4] ..... B22D 39/00

[52] U.S. Cl. ..... 164/337; 164/312; 222/596; 425/561

[58] Field of Search ..... 164/312, 316, 335, 337, 164/339; 222/596; 425/561, 574

[56] References Cited

U.S. PATENT DOCUMENTS

| | | | |
|---|---|---|---|
| 2,520,348 | 8/1950 | Tama | 22/71 |
| 2,660,769 | 12/1953 | Bennett | 22/70 |
| 3,399,428 | 9/1968 | Valyi | 164/312 |
| 3,447,593 | 6/1969 | Nyselius | 164/312 |
| 4,018,417 | 4/1977 | Hanson | 251/63.5 |
| 4,019,970 | 5/1978 | Komiyama et al. | 222/596 |
| 4,408,651 | 10/1983 | Smedley et al. | 164/316 |
| 4,476,912 | 10/1984 | Harvill | 164/316 |

*Primary Examiner*—Francis S. Husar
*Assistant Examiner*—Jorji M. Griffin

[57] ABSTRACT

A die casting apparatus for pumping molten metal from a heated container to a nozzle communicating with an inlet of a mold including a charging mechanism for charging the apparatus with a predetermined amount of molten metal from the container and a multi-piece holder removably joined together by a fastener. The holder defines a shot barrel chamber and a gooseneck chamber extending in a curved path from the charging mechanism to the nozzle. A refractory shot barrel is removably positioned in the shot barrel chamber in communication with the molten metal in the heated container, and two refractory insert halves are removably positioned in the gooseneck chamber and coact to define a gooseneck passage at their parting interface providing fluid communication between the outlet of the shot barrel and the inlet of the nozzle.

9 Claims, 9 Drawing Figures

DIE CASTING APPARATUS

BACKGROUND OF THE INVENTION (1) Field of the Invention

This invention relates to the art of die casting using various hot metals such as zinc alloys, aluminum, lead, tin, brass, and magnesium. More specifically, the instant invention relates to a die casting apparatus for pumping molten metal from a heated container to an injection nozzle communicating with an inlet of a mold.

(2) Description of the Prior Art

The prior art apparatus typically includes a conventional electric crucible furnace for melting and holding casting metal and a pumping assembly for pumping the metal from the crucible to the injection nozzle. In one popular arrangement known as the "hot chamber" method, the pumping assembly includes a shot barrel and gooseneck assembly which is physically immersed in the crucible of the furnace and is selectively operated to pump the hot metal to the injection nozzle. These "hot chamber" machines are capable of high volume production of high quality die cast parts. However, they are unsuitable for casting high melting point metals such as aluminum since the aluminum attacks the ferrous material of the pumping assembly. When casting high melting point metals such as aluminum, a "cold chamber" arrangement has typically been employed in which molten metal from a remote melting pot is ladled into an opening in the upper wall of a horizontal shot cylinder and forced into the die by a plunger. These "cold chamber" machines substantially prevent the molten aluminum from attacking the ferrous material of the pumping assembly. However, these machines do not readily lend themselves to high volume production and, due to the extremely high pressures generated, require very substantial and very expensive construction. Attempts have been made to adapt the "hot chamber" machine to die casting of high melting point metals by providing a ceramic lining in the gooseneck passage. However, this arrangement has not been widely adapted since the lining is difficult to initially manufacture and difficult to replace after the inevitable wear has occured.

SUMMARY OF THE INVENTION

The present invention provides an improved die casting apparatus for pumping molten metal from a heated container to a nozzle communicating with an inlet of a mold. According to the invention, the apparatus includes a housing; a furnace assembly positioned in one end of the housing and including a crucible having an outboard end wall positioned adjacent the adjacent end wall of the housing; a gooseneck assembly positioned in the other end of the housing and defining a gooseneck passage opening at it upper outlet end adjacent the adjacent end wall of the housing and opening upwardly at its lower inlet end at an intermediate location in the housing; a shot barrel positioned in the housing in a generally vertical position intermediate the furnace assembly and the gooseneck assembly with a side wall of the barrel disposed adjacent the inboard end wall of the crucible and the vertical passage of the barrel communicating at its lower end with the upwardly opening inlet end of the gooseneck passage; and a passage extending through the crucible inboard end wall and the side wall of the barrel. This arrangement provides a compact, unitary apparatus for pumping molten metal from the crucible to a nozzle communicating with the outlet end of the gooseneck passage for delivery of the metal through the nozzle to a mold.

According to a further feature of the invention, the die casting apparatus further includes a vertical wall of heat insulative material positioned within the housing and extending totally around the periphery of the assembled furnace assembly, gooseneck assembly, and shot barrel. This arrangement minimizes heat loss as the metal is pumped from the crucible to the nozzle and thereby increases the efficiency of the apparatus.

According to a further feature of the invention, the gooseneck assembly comprises a multi-piece holder; means releasably joining the pieces of the holder together to define an elongated, inclined gooseneck chamber; and refractory insert means removably positioned within the gooseneck chamber and having a centrally elongated passage constituting the gooseneck passage. With this arrangement, the invention apparatus may be used for even very high melting point metals such as aluminum, since the refractory insert prevents the molten metal from attacking the gooseneck holder, and the refractory inserts may be replaced as needed by simple disassembly of the multi-piece holder.

According to another feature of the invention, the refractory insert comprises two insert halves having a parting line extending the length of the refractory insert and passing through the gooseneck passage. This arrangement facilitates fabrication, removal, and replacement of the refractory insert.

According to yet another feature of the invention, the gooseneck assembly further includes a refractory paper insulation disposed about the insert halves and compressed between the insert halves and the adjacent holder pieces upon joining of the holder pieces. This arrangement provides further heat insulation for the metal flowing through the gooseneck passage and firmly cushions the insert halves within the holder in compensation for manufacturing tolerances between the insert halves and the holder chamber and further tolerances occuring as a result of differences in thermal expansion between the insert halves and the holder pieces.

According to yet another feature of the invention, the gooseneck assembly further includes heater means extending along the gooseneck passage to further insure the continued molten state of the metal flowing through the gooseneck.

DETAILED DESCRIPTION OF THE PREFERRED EMBODIMENT

Figure 1:
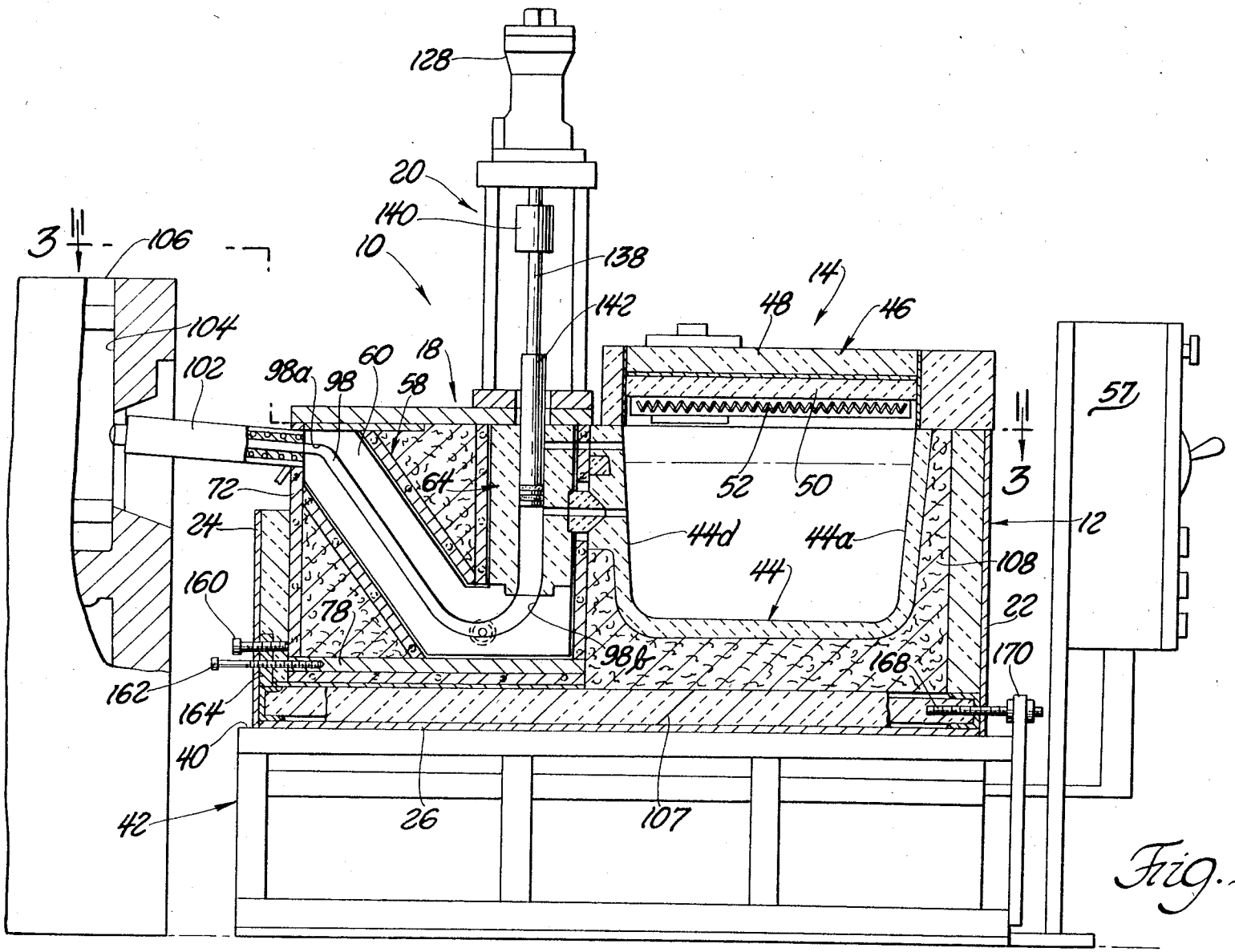
FIG. 1 is a side elevational view in cross-section of the invention die casting apparatus.

Referring to the drawings, the die casting apparatus of the invention is generally seen at 10. Apparatus 10, broadly considered, includes a housing 12, a furnace assembly 14, a gooseneck and shot barrel assembly 18, a pump assembly 20, and a dump assembly 21.

Housing 12 is a composite reinforced sheet metal structure that includes forward and rearward end walls 22 and 24, a bottom wall 26, forward side walls 28 and 30, rearward side walls 32 and 34, and shoulder walls 36 and 38. Housing 12 sits on the upper support or table surface 40 of a support frame 42.

Furnace assembly 14 includes a crucible 44 and a removable lid assembly 46. Crucible 44 is tub shaped and is formed of a suitable refractory material. Lid assembly 46 includes a lid 48 formed as a hollow sheet metal structure and filled with loose wool insulation; an insulating board 50 positioned beneath lid 48; a plurality of heater elements 52 positioned on the underside of board 50; and a filler tube 54 passing through lid 48 and board 50 and having a cover 56. Furnace assembly 14 is positioned in the forward end of housing 12 with the outboard or forward end wall **44*a* of crucible 44 positioned adjacent housing forward end wall 22. A control panel 57 regulates heating elements 52 in known manner to maintain the metal in crucible 44** in a molten condition.

Gooseneck and shot barrel assembly 18 includes a multi-piece holder 58; a pair of refractory insert halves 60, 62; a shot barrel 64; cartridge heaters 66; and compressible means 68.

Holder 58 includes a plurality of steel plates including end plates 70 and 72, side plates 74 and 76, bottom plates 78 and 80, upper and lower angled plates 82 and 84, intermediate plate 86, and top plate 88. The holder plates are releasably joined together by a plurality of fasteners 90 and 92. With its various plates joined together, holder 58 defines an upwardly angled, elongated gooseneck chamber 94 and a vertical shot barrel chamber 96.

Refractory halves 60 and 62 are preferably formed of a small grained graphite material and are removably positioned in gooseneck chamber 94 with their parting line or interface lying in a vertical plane bisecting chamber 94. Halves 60 and 62 each include an elongated hemispherical groove **60*a*, 62*a*. Groove 60*a*, 62*a*, when placed together, coact to define a curvilinear gooseneck passage 98. Each half 60, 62 also includes a pair of external grooves 60*b*, 62*b* which extend lengthwise along the insert half and receive elongated cartridge heaters 66 suitably regulated by control panel 57**.

Shot barrel 64 is preferably formed of a monolithic block of a small grained graphite material shaped to fit snugly within shot barrel chamber 96. Shot barrel 64 includes a central vertical bore or passage **64*a*; four external vertical grooves 64*b* for receipt of four cartridge heaters 66 regulated by panel 57; an upper horizontal passage 64*c* passing through a side wall of the barrel; a central horizontal passage 64*d* passing through the barrel side wall; and a counter bore 64*e* concentric with passage 64*d***.

Compressible means 68 preferably comprises alumina-silica and ceramic fibers formed into a flexible insulated sheet of paper-like material. One such suitable material is available from A P Green Refractories Company, Inswool Division, Subsidiary U.S. Gypsum Company, Highways 69 and 69A, Pryor, Okla. 74362-1220, under the tradename "Inswool".

Figure 8:
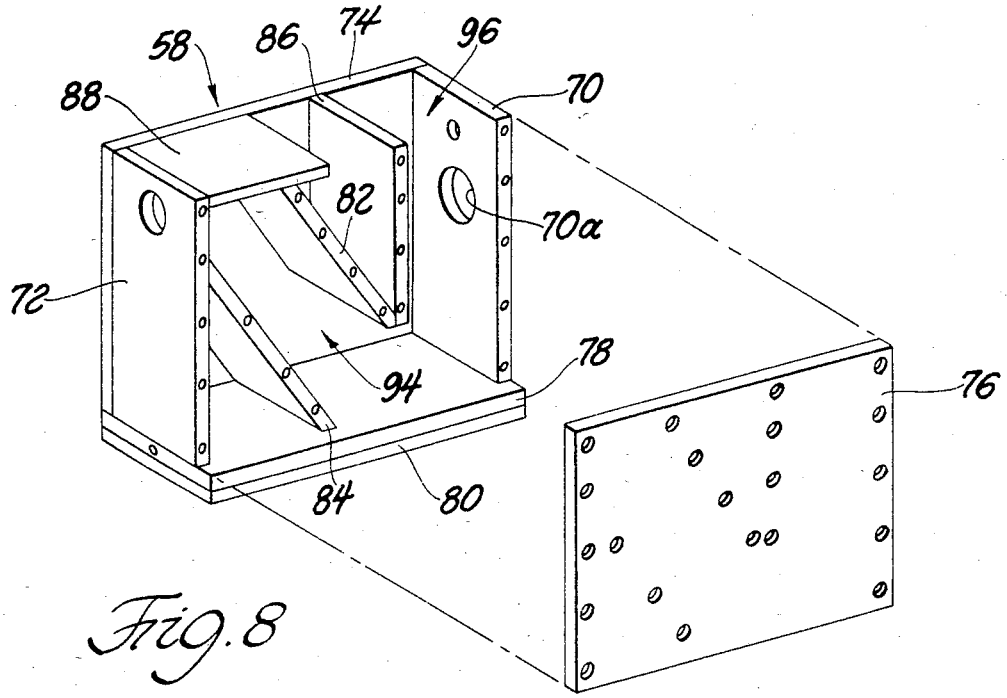
FIG. 8 is a perspective view of the gooseneck and shot barrel holder of the instant invention.

Gooseneck and shot barrel assembly 18 is readily assemblable and disassemblable to facilitate removal and replacement of insert halves 60, 62 and/or shot barrel 64. To assemble assembly 18, the various plates of holder 58 are suitably joined and positioned, as seen in FIG. 8, to form gooseneck chamber 94 and shot barrel chamber 96. Insulating paper 68, cartridge heaters 66, and insert halves 60, 62 are loaded into chamber 94 in a manner such that heaters 66 are positioned in grooves **60*b*, 62*b* and paper 68 total surrounds inserts 60, 62 and heaters 66. Similarily, insulative paper 68, shot barrel 64, and heaters 66 are loaded into shot barrel chamber 96 in a manner such that paper 68 totally surrounds the shot barrel and heaters and a pilot hub 64*f* on the lower end of barrel 64 seats in an inlet counter bore 98*a* formed by the juxtaposed inserts 60, 62. Side plate 76 is now bolted to the assembly to complete chamber 94 and 96 and compressibly trap insert halves 60, 62 and shot barrel 64** therewithin.

Figure 5:
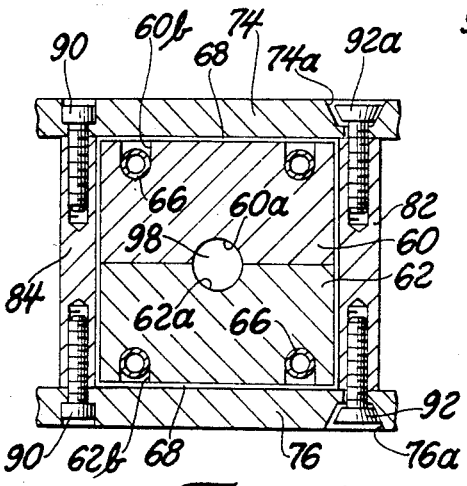
FIG. 5 is a cross-sectional view taken substantially along line 5—5 of FIG. 2.
Figure 6:
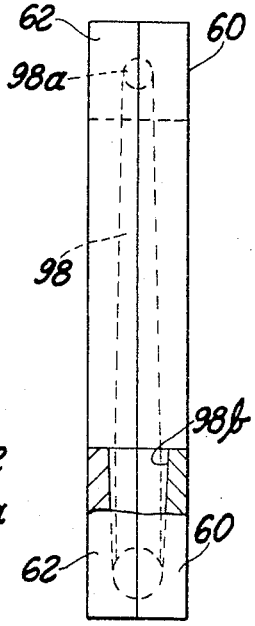
FIG. 6 is an end elevational view, partially broken away, of the refractory insert of the instant invention.
Figure 9:
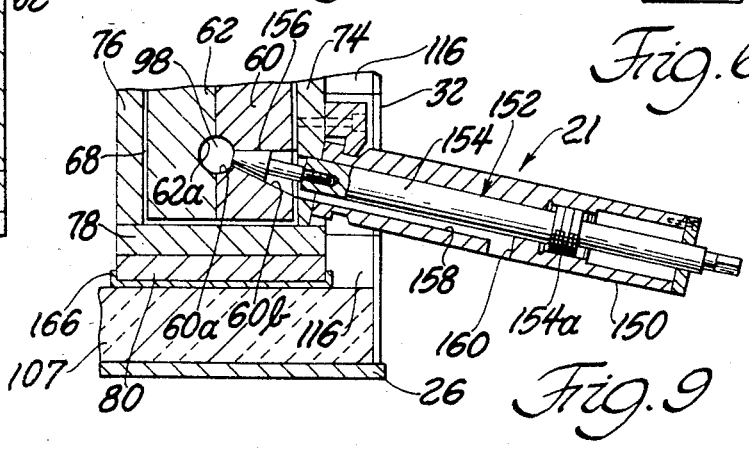
FIG. 9 is a cross-sectional view taken on line 9—9 of FIG. 3 and showing a dumping system employed in the instant invention.
Figure 7:
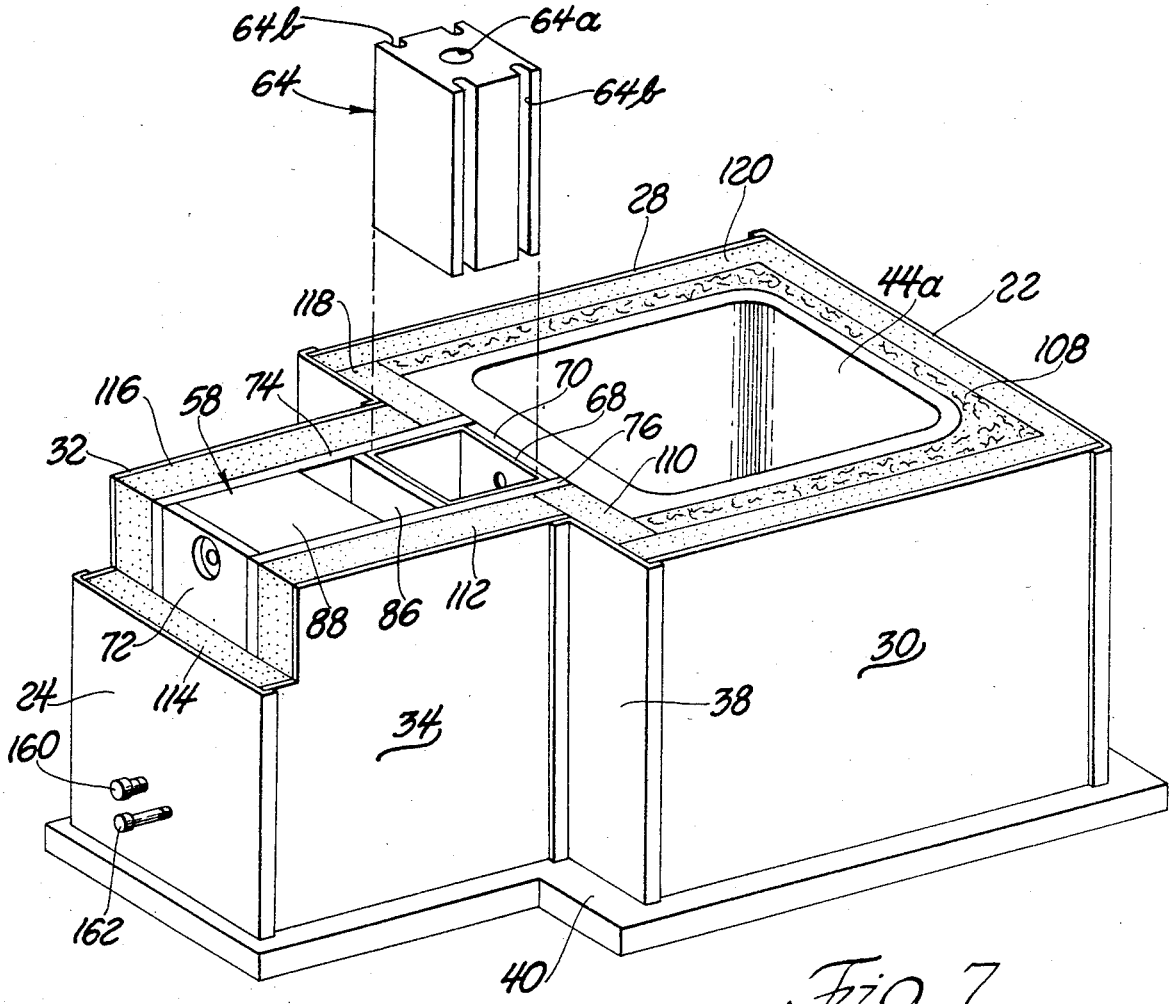
FIG. 7 is a fragmentary perspective view of the invention die casting apparatus.

Specifically, and as best seen in FIG. 5, bolts 90 have straight sided heads received in straight sided counter bores in side plates 74, 76 and pass through snug bores in side plates 74, 76 for threaded engagement with threaded bores in inclined plate 84 and intermediate plate 86. Bolts 92, by contrast, have angled heads **92*a* received in angled countersinks 74*a*, 76*a* in side plates 74, 76 and pass through oversize bores in plates 74, 76 for threaded engagement with threaded bores in inclined plate 82 and front plate 70. As the various plates are buttoned up to tighten bolts 90 and 92, plates 70, 76 are drawn together to compress paper 68 against the sides of inserts 60, 62 and the camming coaction of heads 90*a* and angled countersinks 74*a*, 76*a* as bolts 92 are tightened moves plate 82 toward plate 84 and compresses paper 68 against the top and bottom of inserts 60, 62. Similarily, the drawing together of plates 74, 76 compresses paper 68 against the side walls of shot barrel 68 and the camming coaction of heads 92*a* and countersinks 74*a*, 76*a* as bolts 92 are tightened moves plate 70 toward plate 86 and compresses paper 68 against the front and rear sides of shot barrel 66. Gooseneck and shot barrel assembly 18 thus functions to snugly but readily replacably position inserts 60, 62 and barrel 64 within holder 58. Specifically, the described arrangement provides a snug, positive, cushioned fit for the insert halves and the shot barrel within the holder irrespective of manufacturing tolerances and irrespective of tolerances generated by the differing expansion coefficients of the steel plates of the holder and the graphite of the insert halves and the shot barrel. It is important that the insert halves and shot barrel be snugly cushioned within the holder to insure alignment of the various metal flow passages and protect the fragile graphite from damage. Following insertion of the insert halves and the shot barrel in the holder, a graphite nipple 100 is passed through an opening 70*a* in front holder plate 70 and positioned in shot barrel counter bore 64*e* with a central bore 100*a* of the nipple aligned with shot barrel passage 64*d*. Gooseneck and shot barrel assembly 18 is positioned within housing 12 with the leading conical edge 100*b* of nipple 100 piloting into a conical seat 44*b* provided in the inboard face of a cylindrical boss 44*c* on the inboard crucible end wall 44*d* to align crucible end wall passage 44***e* with passage 100*a* and 64*d* and thereby provide communication between the interior of the crucible and central shot barrel passage 64*a*. As thus positioned, the upper outlet end 98*a* of gooseneck passage 98 opens adjacent housing end wall 72; the lower inlet end 94*b* of the gooseneck passage opens upwardly at an intermediate location in the housing; and shot barrel 64 is vertically positioned in the housing generally between the furnace assembly and the gooseneck assembly with the lower end of shot barrel central passage 64*a* communicating with the upwardly opening gooseneck inlet end 94*b*. A fluid path is thus established between crucible 44 and gooseneck outlet end 94*a*. A nozzle 102 is positioned at one end in a suitable seat in holder plate 72 and communicates with gooseneck outlet end 98*a*. Nozzle 102 communicates at its other end with an inlet of a mold cavity 104 of a die 106. A coil heater 109, suitable regulated by control panel 57, is disposed about the nozzle to heat the nozzle and maintain the metal passing therethrough in a molten state.

The furnace assembly 14 and gooseneck and shot barrel assembly 18, as positioned in housing 12, are totally surrounded by heat insulative material interposed between the assemblies and the housing. Specifically, an insulative board 107 overlies lower housing plate 26 and underlies assemblies 14 and 18; crucible 14 is seated in an insulative tub 108 having an aperture 108*a* in its inboard end wall passing crucible boss 44*c*; insulative boards 110, 112, 114, 116, and 118 surround assembly 18; loose wool insulation 120 is positioned in the space between the outer periphery of tub 180 and the inner periphery of the housing; and custom fitted triangulated insulative blocks 122 and 124 fill the triangular voids in holder 58 above and below gooseneck chamber 94. A top plate 126 complete the encapasulation of assembly 18.

Pump assembly 20 is mounted on top of top plate 126 for coaction with shot barrel 64. Pump assembly 20 includes a cylinder 128 suitably supported on vertical columns 130 upstanding from a base plate 132 positioned on plate 126 over shot barrel 64; a piston 134 positioned within cylinder 128; a piston rod 136; an extension rod 138; a coupler 140 joining rods 136 and 138; and a plunger 142 threadably secured to the lower end of rod 138 and passing downwardly through aligned apertures in plates 132 and 126 and into central passage 64*a* of shot barrel 64. A plurality of piston ringe 144 are positioned in grooves in the lower end of plunger 142. Plunger 142 and rings 144 are preferably formed of a small grained graphite material. A pair of passages 146 open at their lower ends in the lower face of plunger 142 and open at their upper ends in diametrically opposed locations in the side wall of plunger 142 above rings 144 to equalize pressure above and below the rings. Cylinder 128 includes an inlet 148 adapted for connection to a source of hydraulic or air pressure to actuate the pumping means in known manner.

Dump assembly 21 includes a cylindrical housing 150 and a valving assembly 152 movable axially within housing 150. Housing 150 is downwardly sloped and passes at its upper inboard end through suitable openings in housing side wall 32 and insulative board 116 for suitable clamping securement to holder plate 74. Valving assembly 152 includes a main body member 154 threadably coacting at 154*a* with housing 150, and a conical tip 156 threadably secured to the inboard end of member 154. The inboard end of member 154 passes through a suitable opening in holder plate 74 and tip 156 coacts with a conical passage 60*b* extending through insert half 60 for communication with gooseneck passage 98 at its lowest point. Tip 156 is normally seated tightly in passage 60*b* but may be withdrawn from seating engagement by axial threaded movement of main body member 154 in housing 150 to allow molten metal in gooseneck passage 98 to drain through passages 158 and 160 and achieve substantially total drainage of the molten metal from the apparatus in the event of a power failure or other misadventure during a casting operation.

To prepare apparatus 10 for use, holder 58 is loaded in the manner described with insert halves and a shot barrel of a material and dimensions to match the particular desired casting operation. The assembly 18 is then positioned, as a module, within housing 12 and within the insulative wall and adjusted longitudinally to tightly and accurately seat nipple 100 in conical seat 44*b* of the crucible. This adjustment is accomplished by a pair of adjustment screws 160 and 162 passing through housing end well 24 and through a reinforcing plate 164. Screw 160 abuttingly engages holder end plate 72 and screw 162 threadably engages holder bottom plate 78. Screw 160 and 164 thus provide respective pushing and pulling engagement with holder 58 to move the holder selectively and slidably along a channel track member 166 and move nipple 100 into seating engagement with crucible seat 44*b*.

After the assembly 18 has thus been acurately positioned within the housing, nozzle 102 is positioned in alignment with gooseneck outlet 98*a* and an adjustment screw 168, supported on a support structure bracket 170 and threadably engaging the housing, is operated to slide the entire die casting apparatus to the left, as viewed in FIG. 1, on support surface 40 and move the outlet tip of nozzle 102 into firm seating engagement with die 106.

Figure 2:
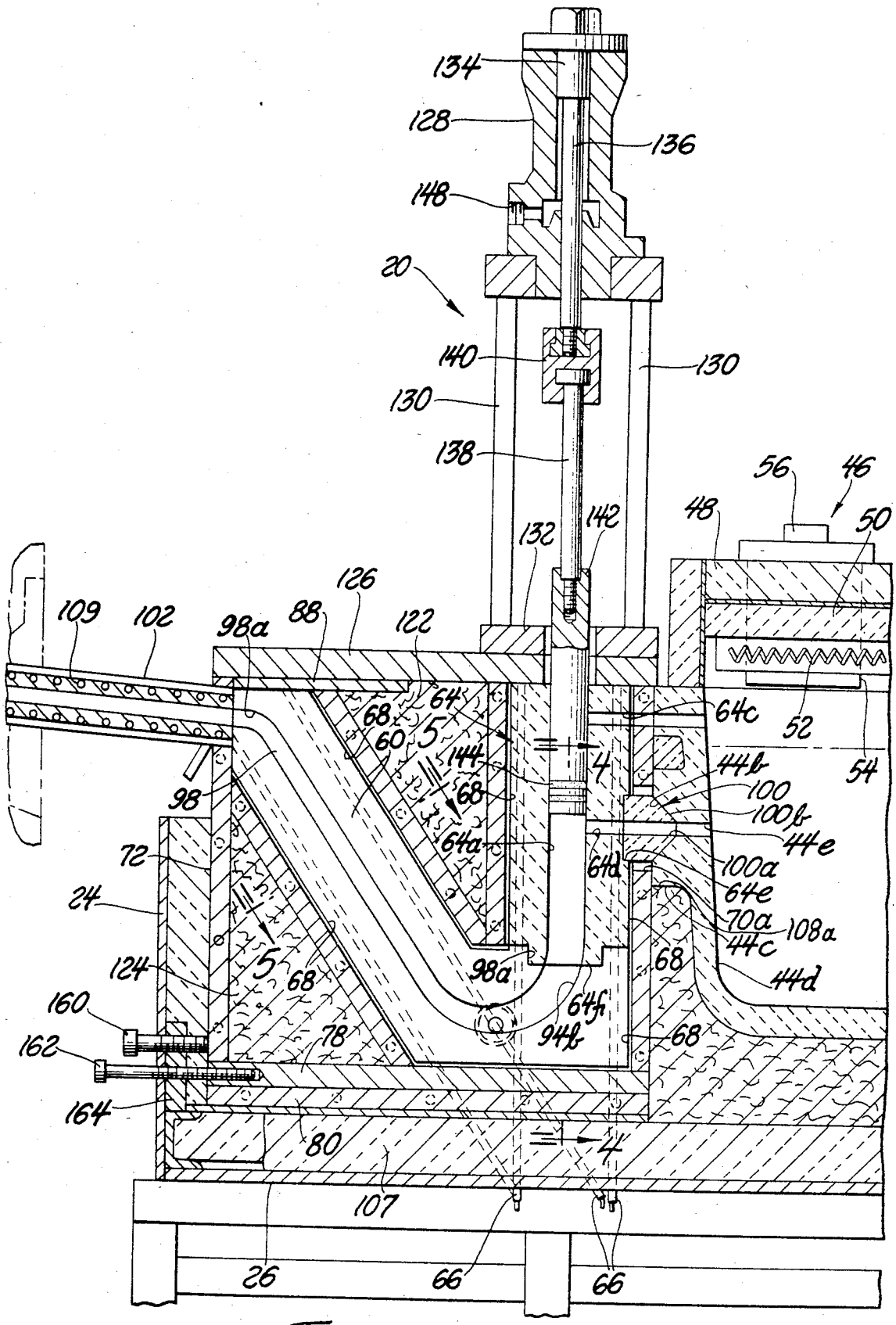
FIG. 2 is a fragmentary enlarged cross-section view corresponding to FIG. 1 with parts partially broken away to illustrate certain details of the instant invention.
Figure 3:
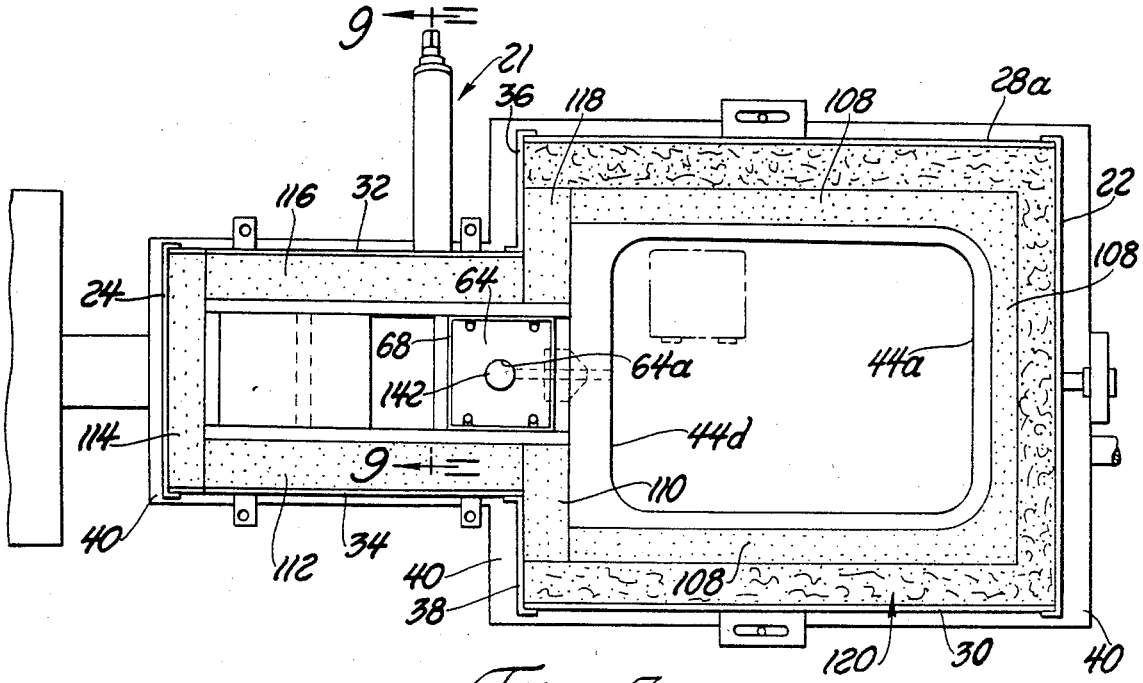
FIG. 3 is a top plan view partially broken away, taken generally along line 3—3 of FIG. 1.
Figure 4:
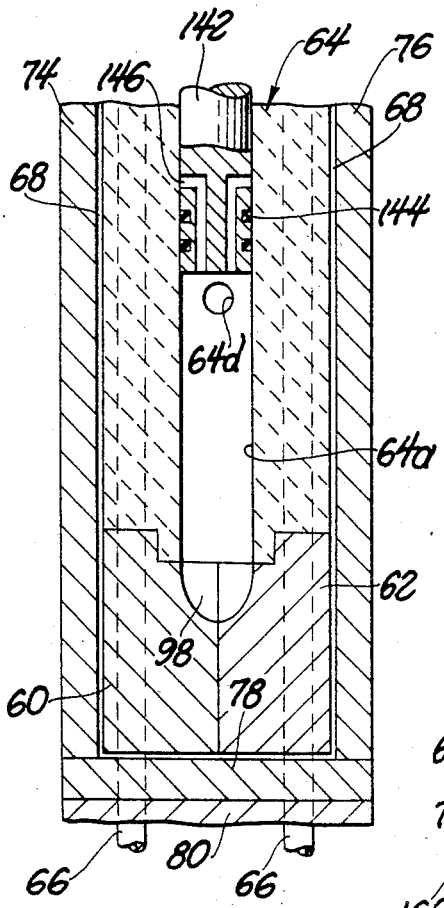
FIG. 4 is a cross-sectional view taken substantially along line 4—4 of FIG. 2.

Apparatus 10 is now ready for die casting use. Molten metal is loaded into crucible 44 through filler tube 54 and maintained in a molten condition by elements 52. Plunger 142 is normally in the position seen in FIGS. 1 and 2 so that molten metal fills the shot barrel below the plunger and fills gooseneck passage 98 to a level just below gooseneck outlet opening 98*a*. When plunger 142 is moved downwardly by suitable actuation of cylinder 128, a shot of molten metal is injected into die 106 through nozzle 102 in known manner. The entire path of the molten metal as it moves from crucible 44 to nozzle 102 is defined by refractory material. Specifically, the molten metal is propelled by a graphite plunder 142 and flows through refractory crucible 44, graphite nipple 100, graphite shot barrel 64, and graphite insert halves 60, 62. Further, the entire path of the material is heated. Specifically, the metal in the crucible is heated by heating elements 52 and the metal flowing through shot barrel 64 and gooseneck passage 98 is heated by cartridge heaters 66. Further, the entire path of the metal is readily maintained at a very high temperature since the insulative blanket totally surrounding the furnace assembly and the gooseneck and shot barrel assembly virtually precludes any substantially loss of heat from the system. By virtue of the totally refractory flow path, the effective heating along the entire length of the flow path, and the total insulation of the entire flow path, the invention die casting apparatus may be readily and effectively used with any castable metal, including even high melting point metals such as aluminum or magnesium. And the invention die casting apparatus allows ready replacement of the various die casting components. Specifically, when it is desired or required to replace any or all of the die casting components in holder 58, either to adapt the apparatus to a different casting requirement or to replace worn or deteriorated components, housing 12 is suitably opened, insulation is selectively removed and a side plate of the holder 58 is removed to expose the contents, whereafter the insert halves and/or shot barrel and/or insulative paper and/or cartridge heaters may be selectively removed and replaced as required and the holder and housing readily reassembled.

Whereas a preferred embodiment of the invention has been illustrated and described in detail, it will be apparent that various changes may be made in the preferred embodiment without departing from the scope or spirit of the invention.

The embodiments of the invention in which an exclusive property or privilege is claimed are defined as follows:

1. A die casting apparatus for delivering molten metal to a nozzle communicating with an inlet of a mold, said apparatus comprising:

(a) a housing;

(b) a furnace assembly positioned in said housing adjacent one end thereof and including a crucible for holding molten metal to be cast having an outboard end wall disposed adjacent one end wall of said housing;

(c) a gooseneck assembly positioned in said housing adjacent the other end thereof and defining a gooseneck passage opening at its upper outlet end adjacent another end wall of said housing opposite said one end wall for communication with the nozzle and opening upwardly at its lower inlet end at an intermediate location in said housing;

(d) a shot barrel positioned in said housing in a generally vertical position intermediate said furnace assembly and said gooseneck assembly with a side wall of the barrel disposed adjacent the inboard end wall of said crucible and the vertical bore of the barrel communicating at its lower end with the upwardly opening inlet end of said gooseneck passage; and (e) a passage extending through said crucible inboard side wall and through said shot barrel side wall to provide molten metal communication between said crucible and said vertical bore of said shot chamber;

(f) said gooseneck assembly comprising (1) a multi-piece holder, (2) means releasably joining the pieces of said holder together to define an elongated, inclined gooseneck chamber, and (3) refractory insert means removably positioned within said gooseneck chamber and having a central elongated passage constituting said gooseneck passage;

(g) said refractory insert means comprising two insert halves having a parting line extending the length of said refractory insert means passing through said gooseneck passage; and (h) compressible means compressed between the joined pieces of said holder and said insert halves for accomodating the difference in thermal expansion between said holder pieces and said insert halves.

2. A die casting apparatus according to claim 1 wherein said compressible means comprises a refractory paper insulation disposed about said insert halves and compressed between said insert halves and the adjacent holder pieces upon joining of the holder pieces.

3. A die casting apparatus for delivering molten metal to a nozzle communicating with an inlet of a mold, said apparatus comprising:

(a) a housing;

(b) a furnace assembly positioned in said housing adjacent one end thereof and including a crucible for holding molten metal to be cast having an outboard end wall disposed adjacent one end wall of said housing;

(c) a gooseneck assembly positioned in said housing adjacent the other end thereof and defining a gooseneck passage opening at its upper outlet end adjacent another end wall of said housing opposite said one end wall for communication with the nozzle and opening upwardly at its lower inlet end at an intermediate location in said housing;

(d) a shot barrel positioned in said housing in a generally vertical position intermediate said furnace assembly and said gooseneck assembly with a side wall of the barrel disposed adjacent the inboard end wall of said crucible and the vertical bore the barrel communicating at its lower end with the upwardly opening inlet end of said gooseneck passage; and (e) a passage extending through said crucible inboard side wall and through said shot barrel side wall to provide molten metal communication between said crucible and said vertical bore of said shot chamber;

(f) said gooseneck assembly comprising (1) a multi-piece holder, (2) means releasably joining the pieces of said holder together to define an elongated inclined gooseneck chamber, (3) two refractory insert halves positioned within said gooseneck chamber and defining said gooseneck passage at their parting innerface, (4) compressible insulation means disposed around the insert halves and compressed between said insert halves and the adjacent holder pieces upon joining of the holder pieces, and (5) at least two elongated cartridge heaters extending along opposite sides of said gooseneck passage.

4. A die casting apparatus for pumping molten metal from a heated container to a nozzle communicating with an inlet of a mold, said apparatus comprising:

(a) charging means for charging said apparatus with a predetermined amount of molten metal from the container;

(b) a multi-piece holder;

(c) means releasably joining the pieces of said holder together to define an elongated chamber extending from said charging means to the nozzle; and (d) refractory insert means disposed within said chamber and defining a curved passage therethrough for providing fluid communication between said charging means and the nozzle;

(e) said refractory insert means including two insert halves having a parting line extending the length of said refractory insert means;

(f) said apparatus further including compressible means compressed between the joined pieces of said holder and said insert halves for accomadating the difference in thermal expansion between said holder pieces and said insert halves.

5. A die casting apparatus according to claim 4 wherein said compressible means comprises a refractory paper insulation disposed about said insert halves and compressed between said insert halves and the adjacent holder pieces upon joining of the holder pieces.

6. A die casting apparatus according to claim 5 and further including (f) heater means extending along said passage to maintain the metal flowing therethrough in a molten condition.

7. A die casting apparatus according to claim 6 wherein (g) said heater means comprise at least two elongated cartridge heaters extending respectively along opposite sides of said passage.

8. A die casting apparatus comprising:

(a) container means for containing molten metal, said container means including an outlet;

(b) a nozzle adapted for communication with an inlet of a mold cavity; and (c) means for pumping the molten metal from said container means to said nozzle and including (1) a multi-piece holder, (2) means releasably joining the pieces of said holder together to define an elongated chamber, and (3) refractory insert means replaceably disposed within said chamber and having a passage therethrough extending between said outlet of said container means and said nozzle;

(d) said refractory insert means including two insert halves having a parting line extending the length of said refractory insert means;

(e) said apparatus further including compressible means compressed between said insert halves and said holder pieces for accomodating the difference in thermal expansion between said holder pieces and said insert halves.

9. An apparatus according to claim 8 wherein said compressible means comprises a refractory paper insulation disposed about said insert halves and compressed between said insert halves and the adjacent holder pieces upon joining of the holder pieces.

* * * * *